United States Patent [19]

Kikuchi et al.

[11] Patent Number: 4,830,527

[45] Date of Patent: May 16, 1989

[54] PRINTER WITH IMPROVED PINCH ROLLER ACTUATING MECHANISM

[75] Inventors: Hiroshi Kikuchi; Shyoichi Watanabe; Yukio Ohta, all of Tokyo, Japan

[73] Assignee: Oki Electric Industry Co., Ltd., Tokyo, Japan

[21] Appl. No.: 111,030

[22] Filed: Oct. 20, 1987

[30] Foreign Application Priority Data

Oct. 24, 1986 [JP] Japan ..... 61-162347[U]
Oct. 27, 1986 [JP] Japan ..... 61-253565

[51] Int. Cl.[4] ..... B41J 13/036
[52] U.S. Cl. ..... 400/637.2; 400/637.3
[58] Field of Search ..... 400/636.1, 636.2, 636.3, 400/637, 637.1, 637.2, 637.3, 637.4, 637.5, 637.6

[56] References Cited

U.S. PATENT DOCUMENTS

| | | | |
|---|---|---|---|
| 442,633 | 12/1890 | Merritt | 400/637.2 |
| 2,134,343 | 10/1938 | Salzberger | 400/637.2 X |
| 2,627,333 | 2/1953 | Butler | 400/637 X |
| 4,518,271 | 5/1985 | Hirata | 400/636.1 |
| 4,522,520 | 6/1985 | Takenoya et al. | 400/636.1 |

FOREIGN PATENT DOCUMENTS

| | | | |
|---|---|---|---|
| 93372 | 5/1984 | Japan | 400/637 |
| 150770 | 8/1984 | Japan | 400/637.2 |
| 252542 | 10/1948 | Switzerland | 400/637.4 |

*Primary Examiner*—Charles A. Pearson
*Attorney, Agent, or Firm*—Wenderoth, Lind & Ponack

[57] ABSTRACT

A printer includes a stationary paper chute extending along the outer peripheral surface of a platen over a limited angular extent thereof so as to define therebetween a paper feed passage, the paper chute having an opening through which a pinch roller is movable into and out of the paper feed passage for releasably locking a paper on the platen. The printer further has a pinch roller actuating mechanism which includes a pressure spring disposed adjacent to the paper chute for biasing the pinch roller against the platen, the pressure spring being composed of a cantilevered resilient strip having a free end on which the pinch roller is rotatably supported, and a release camshaft rotatably disposed between the paper chute and the pressure spring and angularly movable to resiliently displace the pressure spring in a direction to move the pinch roller away from the platen.

6 Claims, 7 Drawing Sheets

PRINTER WITH IMPROVED PINCH ROLLER ACTUATING MECHANISM

BACKGROUND OF THE INVENTION

The present invention relates generally to printers, and more particularly to a pinch roller actuating mechanism incorporated in such printers for moving pinch rollers toward and away from a platen to releasably lock a paper on the platen.

There are various known mechanisms for use in the printing unit of a printer for actuating pinch rollers to move toward and away from a platen for releasably locking a paper in position on the platen. A typical example of a known pinch roller actuating mechanism is shown in FIGS. 1 and 2 of the accompanying drawings. The printing unit in which the actuating mechanism is incorporated includes a cylindrical platen 1 rotatably supported on a side frame 7, a printing head 2 facing the front side of the platen 1, a paper chute 3 extending arcuately along a lower part of the platen 1 from the back to the front side thereof for defining, jointly with the platen 1, an arcuate paper feed passage, and a pinch roller 4 rotatably mounted on one end of the paper chute 3 adjacent to the printing head 2, the paper chute 3 being pivotably connected at its intermediate portion to a shaft 8 secured to the side frame 7. The pinch roller actuating mechanism includes a presser spring composed of a tension coil spring 5 acting on the other end of the paper chute 3 to pivot the latter about the shaft 8 in the clockwise direction to bring the pinch roller 4 into pressing engagement with the platen 1 (FIG. 1), and a horizontal release camshaft 6 rotatably supported at its opposite ends on the side frame 7 and engageable with the paper chute 3 to turn the latter counterclockwise about the shaft 8 against the bias of the pressure spring 5, thereby retracting the pinch roller 4 away from the platen 1 (FIG. 2).

To move the pinch roller 4 from the advanced paper-locking position shown in FIG. 1 to the retracted paper-releasing position shown in FIG. 2, the release camshaft 6 is turned about its own axis in the direction of the arrow A through an angle of about 90 degrees. With this angular movement, a cam follower 3*a* on the paper chute 3 is lifted by the camshaft 6, thereby causing the paper chute 3 to be turned in the direction of the arrow B against the bias of the pressure spring 5. As a consequence of the angular movement of the paper chute 3, the pinch roller 4 is retracted arcuately away from the platen 1 in a direction indicated by the arrow C.

The known printer incorporating such a pinch roller actuating mechanism has various drawbacks as follows: Since the release camshaft 6 and the paper chute 3 are structurally separated from one another and hence are required to be assembled with the side plate 7 separately, an automatized assembling of the printer is difficult to achieve. Another drawback is that the pressure spring 5 must have a spring force strong enough to urge the paper chute 3 and the pinch roller mounted thereon toward the platen 1. The release camshaft 6 is likely to be bent or deformed as it is always subjected to such a strong spring force. With the release camshaft 6 thus deformed, reliable paper supply is difficult to obtain.

SUMMARY OF THE INVENTION

It is accordingly an object of the present invention to provide a printer having an improved pinch roller actuating mechanism incorporating structural features which enable an automatized assembling of the printer.

Another object of the present invention is to provide a pinch roller actuating mechanism having a release camshaft which is free from objectionable deformation and hence is capable of supplying a paper smoothly and reliably over a platen.

According to the present invention, a printer includes a stationary paper chute extending along the outer peripheral surface of a platen over a limited angular extent thereof so as to define therebetween a paper feed passage, the paper chute having an opening through which a pinch roller is movable into and out of said paper feed passage for releasably pressing a paper against the platen. The printer further has a pinch roller actuating mechanism which includes a pressure spring disposed adjacent to the paper chute for urging the pinch roller against the platen, the pressure spring being composed of a cantilevered resilient strip having a free end on which the pinch roller is rotatably supported, and a release camshaft rotatably disposed between the paper chute and the pressure spring and angularly movable to resiliently displace the pressure spring in a direction to move the pinch roller away from the platen.

Since the release camshaft is structurally united with the paper chute, it is possible to assemble the paper chute and the release camshaft simultaneously with a side frame. This united arrangement is particularly suitable for an automatized assembling of the printer. The pressure spring acting directly on the pinch roller has a relatively small spring force and hence is unlikely to bend or deform the release camshaft.

Many other advantages and features of the present invention will become manifest to those versed in the art upon making reference to the detailed description and the accompanying sheets of drawings in which preferred structural embodiments incorporating the principles of the present invention are shown by way of illustrative example.

DESCRIPTION OF THE PREFERRED EMBODIMENTS

Figure 1:
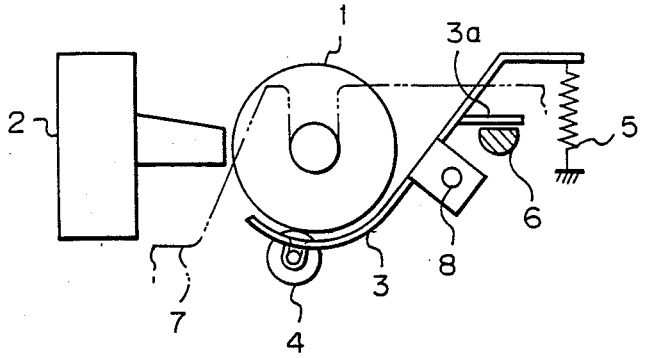
Fig. 1 PRIOR ART
FIG. 1 is a schematic side elevational view, partly in cross section, of the printing unit of a prior art printer, showing parts in a paper-locking position.
Figure 2:
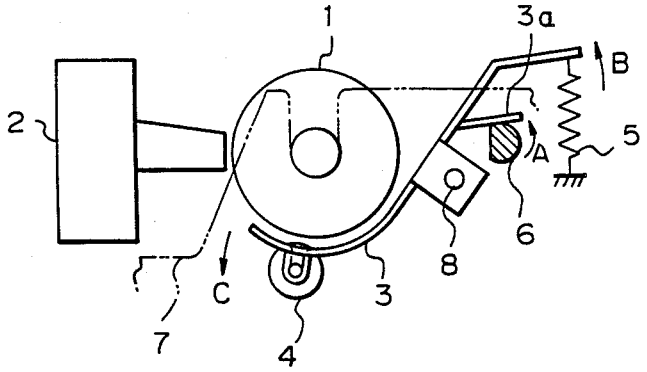
Fig. 2 PRIOR ART
FIG. 2 is a view similar to FIG. 1, showing parts in a paper-releasing position.
Figure 3:
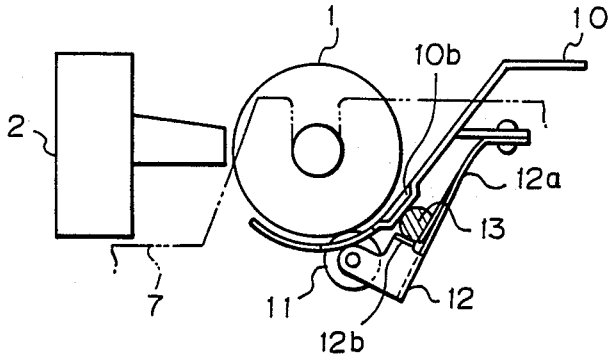
FIG. 3 is a schematic side elevational view, partly in cross section, of a printing unit of a printer embodying the present invention, showing parts in a paper-locking position.
Figure 4:
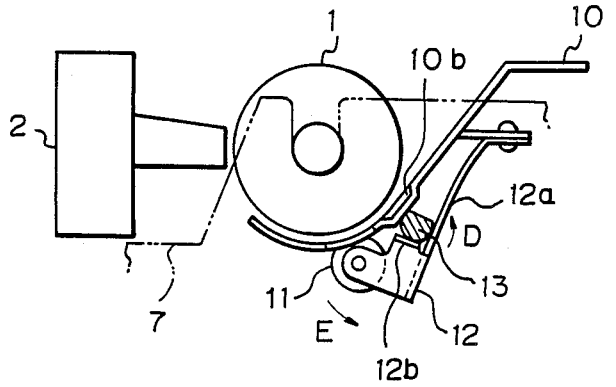
FIG. 4 is a view similar to FIG. 3, showing the printing unit with parts in a paper-releasing position.
Figure 5:
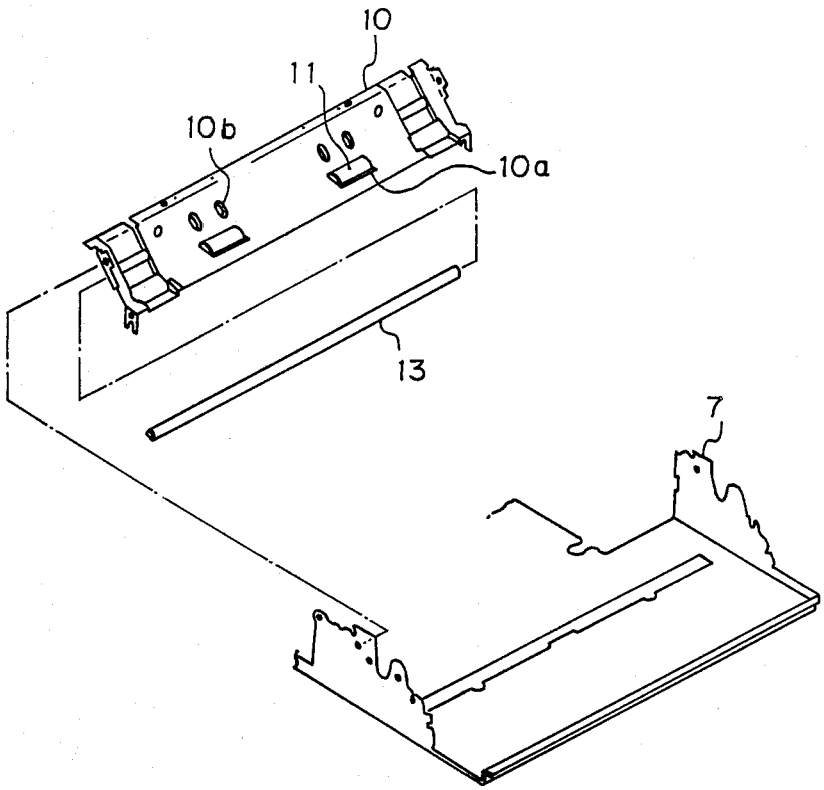
FIG. 5 is a fragmentary exploded perspective view of a portion of the printing unit shown in FIG. 3.

FIGS. 3 and 4 show a printing unit of a printer embodying the present invention. The printing unit includes a cylindrical platen 1 rotatably supported on a side frame 7, a printing head 2 facing the front side of the platen 1, a paper chute 10 extending arcuately along an outer peripheral surface of the platen 1 over a lower portion thereof so as to define therebetween a paper feed passage, and a pair of pinch rollers 11 (only one shown) for pressing a paper against the platen 1. The paper chute 10 is fixedly connected at its opposite ends to the side frame 7 and has a pair of laterally spaced rectangular openings 10*a* through which the pinch rollers 11 are movable into and out of the paper feed passage, and a pair of parallel spaced guide projections 10*b* formed on the underside thereof respectively adjacent to each of the openings 10*a*, as shown in FIG. 5.

The present unit further includes a mechanism for actuating the pinch rollers 11 to move toward and away from the platen 1 to releasably lock the paper on the platen 1. The pinch roller actuating mechanism includes a pressure spring 12 for urging each of the pinch rollers 11 against the platen 1 and a release camshaft 13 for moving the pinch rollers 11 away from the platen 1 against the force of the pressure spring 12. The pressure spring 12 is composed of a cantilevered resilient strip having a free end on which the pinch roller 11 is rotatably supported, the other end of the cantilevered pressure spring 12 being secured by riveting, for example, to the paper chute 10. The release camshaft 13 is rotatably disposed between the paper chute 10 and the pressure spring 12 and has an outer peripheral cam surface of a substantially semi-circular shape held between and in contact with the guide projections 10*b* and the pressure spring 12.

Figure 6:
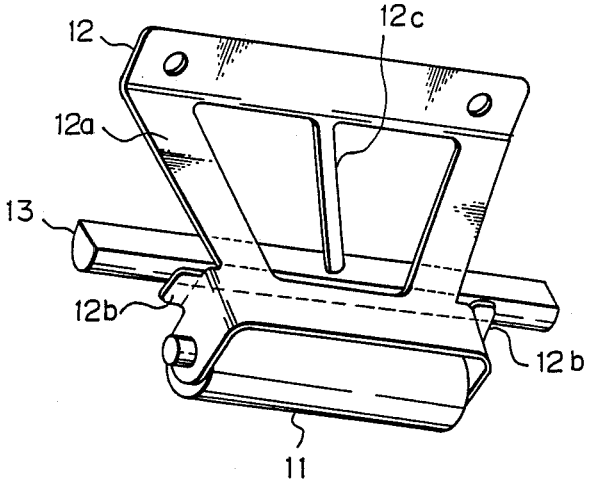
FIG. 6 is an enlarged perspective view of a pinch roller actuating mechanism incorporated in the printing unit shown in FIG. 3.

The pressure spring 12, as shown in FIG. 6, is press-formed from a resilient strip of metal and includes an apertured central spring portion 12*a* constituting a major part of the pressure spring 12 and extending between the fixed end and the pinch-roller supporting free end, a retainer portion 12*b* disposed adjacent to the free end and extending at a right angle to the general plane of the spring portion 12*a*, and a resilient tongue 12*c* extending into a central aperture in the spring portion 12*a* at an angle to the general plane of the spring portion 12*a*.

Figure 7:
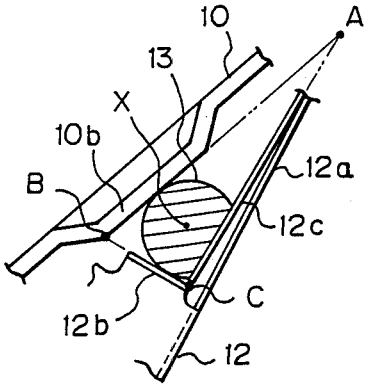
FIG. 7 is an enlarged side elevational view of a portion of FIG. 3.
Figure 8:
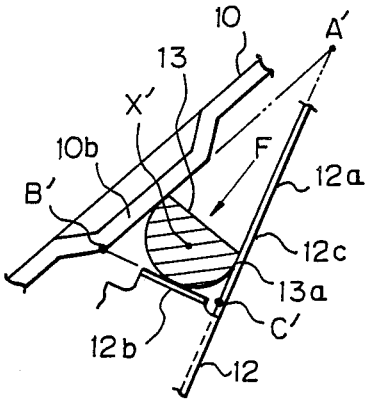
FIG. 8 is an enlarged side elevational view of a portion of FIG. 4.

The pressure spring 12 as attached to the paper chute 10 extends at an angle to the paper chute 10 such that a generally right-angled triangular space is defined jointly between the projection 10*b*, the spring portion 12*a* and the retainer portion 12*b*, as shown in FIGS. 7 and 8. The triangular space flares or spreads (become larger) in a direction from the fixed end to the free end of the cantilevered pressure spring 12. The release camshaft 13 is resiliently held within the triangular space by the foregoing portions 12*a* 12*b*, 10*b* and is rotatable about its own axis X. The release camshaft 13 may be rotatably mounted on the paper chute 10.

Since the release camshaft 13 is structurally united with the paper chute 10, it is possible to assemble the paper chute 10 and the release camshaft 13 simultaneously with a side frame 7. Such a united arrangement is particularly suitable for an automatized assembling of the printer. The pressure spring 12 acting directly on the pinch roller 11 has a relatively small spring force and hence is unlikely to bend or deform the release camshaft 13.

The operation of the pinch roller actuating mechanism is described below with reference to FIGS. 3, 4, 7 and 8. For purposes of illustration, the operation begins with parts in the condition shown in FIGS. 3 and 7 in which the pinch roller 11 is urged against the platen 1 under the force of the pressure spring 12. In this instance, the projection 10*b*, the resilient tongue 12*c* and the retainer portion 12*b* are held in contact respectively with an arcuate cam surface portion of the release camshaft 13, a flat cam surface portion of the camshaft 13, and the arcuate cam surface portion of the camshaft 13. Thus, the release camshaft 13 is resiliently held within a triangular space having apexes A, B, C which is defined between the foregoing portions 10*b*, 12*c*, 12*b*, as shown in FIG. 7. The camshaft 13 is rotatable about a longitudinal axis X.

Then the release camshaft 13 is turned about its own axis in the direction of the arrow D through an angle of 90 degrees, as shown in FIG. 4, whereupon one apex 13*a* of the semi-circular cam surface urges the resilient tongue 12*c* downwardly toward the spring portion 12*a* against the resiliency of the resilient tongue 12*c*. A further angular movement of the camshaft 13 causes the apex 13*a* to engage the spring portion 12*a* and then depress the pressure spring 12 per se away from the paper chute 10 in the direction indicated by the arrow E, thereby releasing the pinch roller 11 from pressing engagement with the platen 1. In this instance, the spring portion 12*a* is held in contact with the apex 13*a* of the camshaft 13, the projection 10*b* with the other apex of the camshaft 13, and the retainer portion 12*b* with the arcuate cam surface portion. Thus, the release camshaft 13 is resiliently held within a triangular space defined between the foregoing portions 12*a*, 10*b*, 12*b* and having apexes A', B', C', as shown in FIG. 8. The camshaft 13 thus disposed has a longitudinal axis of rotation X' which is substantially identical in position to the axis X shown in FIG. 7. Since the camshaft 13 is continuously urged under the force of the pressure spring 12 in the direction indicated by the arrow F, against displacement in the direction toward the apex A'. With this spring force, the camshaft 13 can be held between the paper chute 10 and the pressure spring 12 without the necessity of a separate retaining means.

When a paper is to be locked on the platen 1, the release camshaft 13 is turned clockwise about its own axis through an angle of 90 degrees, whereupon the pinch roller 11 is moved from the paper-releasing position shown in FIG. 4 to the paper-locking position shown in FIG. 3 under the force of the pressure spring 12.

Figure 9:
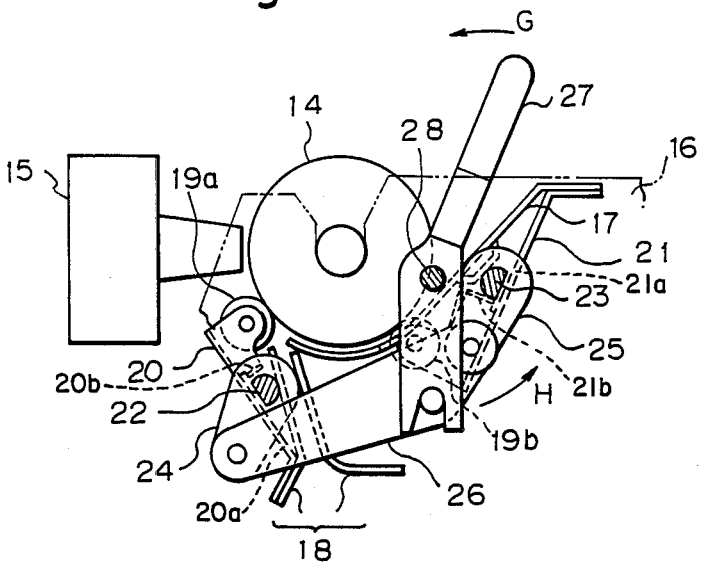
FIG. 9 is a schematic side elevational view, partly in cross section, of a modified printing unit according to the present invention, the view showing parts in a paper-locking position.
Figure 10:
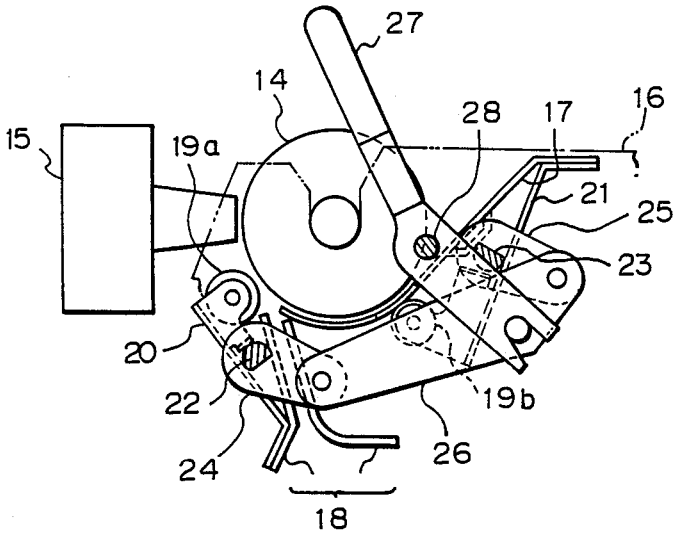
FIG. 10 is a view similar to FIG. 9, showing the printing unit with parts in a paper-releasing position.
Figure 11:
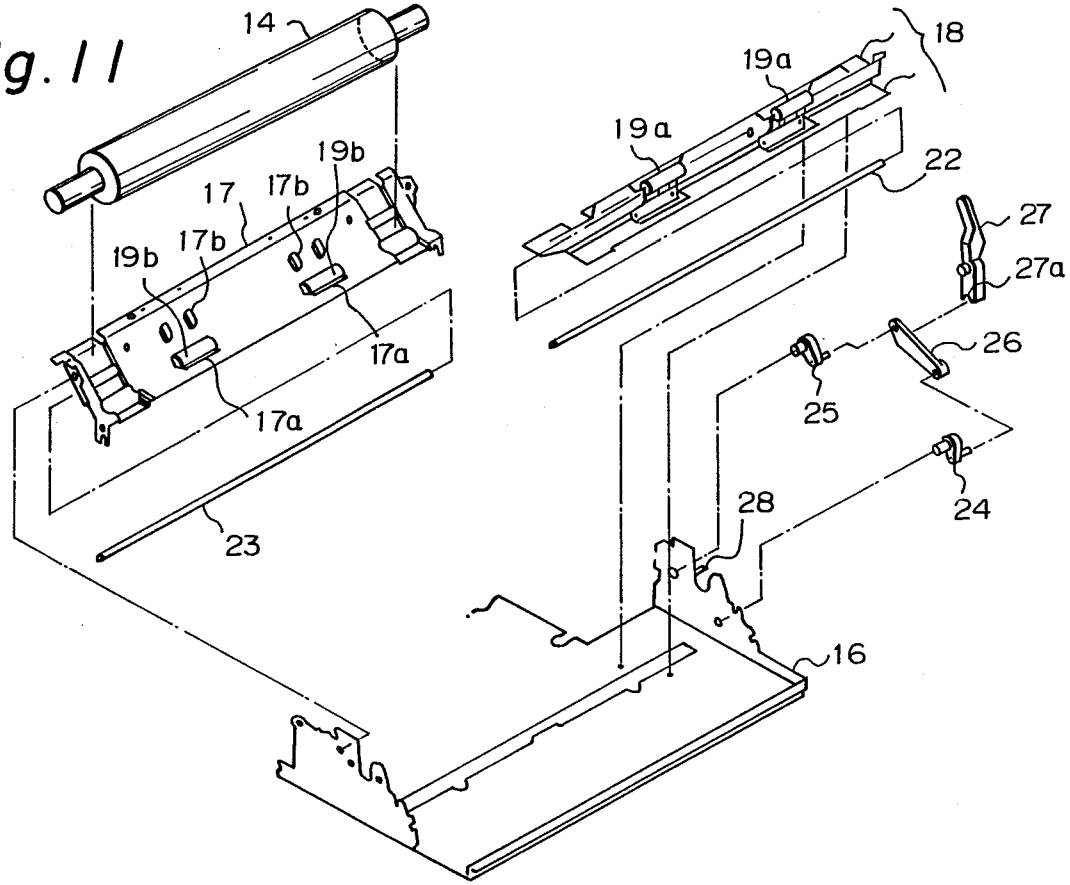
FIG. 11 is a fragmentary exploded perspective view of a portion of the printing unit shown in FIG. 9.

FIGS. 9 through 11 show a modified printing unit so constructed as to supply two papers over a platen from different directions. The printing unit includes a cylindrical platen 14 rotatably supported on a side frame 16, a printing head 15 facing the front side of the platen 14, a paper chute 17 extending arcuately along an outer peripheral surface of the platen 14 over a lower portion thereof so as to define therebetween a first paper feed passage, and a pair of first pinch rollers 19b (FIG. 11) for pressing a first paper against the platen 14. The paper chute 17 is fixedly connected at its opposite ends to the side frame 16 and has a pair of laterally spaced rectangular openings 17a through which the pinch rollers 19b are movable into and out of the first paper feed passage, and a pair of parallel spaced guide projections 17b formed on the underside thereof respectively adjacent to each of the openings 17a, as shown in FIG. 11. The printing unit further includes a first mechanism for actuating the first pinch rollers 19b to move toward and away from the platen 14 to releasably lock the first paper on the platen 14. The pinch roller actuating mechanism includes a first pressure spring 21 for urging each of the pinch rollers 19b against the platen 14 and a first release camshaft 23 for moving the pinch roller 19b away from the platen 14 against the force of the pressure spring 21. The pressure spring 21 is composed of a cantilevered resilient strip having a free end on which the pinch roller 19b is rotatably supported, the other end of the cantilevered pressure spring 21 being secured by riveting, for example, to the paper chute 17. The release camshaft 23 is rotatably disposed between the paper chute 17 and a spring portion 21a and a retainer portion 21b of the pressure spring 21 and has an outer peripheral cam surface of a substantially semi-circular shape. All of the foregoing structural components of the modified printing unit are substantially identical to those in the embodiment shown in FIGS. 3 to 8 and hence will require no further description.

The modified printing unit differs from the first-mentioned printing unit in that a paper guide 18 is disposed adjacent to the front end of the paper chute 17 and a pair of second pinch rollers 19a (FIG. 11) is disposed upstream of a second paper feed passage defined in the paper guide 18. The paper guide 18 is secured to the side frame 16. Each of the second pinch rollers 19a is actuated to move into and out of contact with the platen 14 by means of a second pinch roller actuating mechanism. The second pinch roller actuating mechanism is structurally and functionally the same as the first pinch roller actuating mechanism and includes a second pressure spring 20 for urging each of the second pinch rollers 19a against the platen 14 and a second release camshaft 22 for moving the pinch roller 19a away from the platen 14 against the force of the second pressure spring 20. The pressure spring 20 is composed of a cantilevered resilient strip having a free end on which the pinch roller 19a is rotatably supported, the other end of the pressure spring 20 being secured by riveting, for example, to the paper guide 18. The second release camshaft 22 is rotatably disposed between the paper guide 18 and a spring portion 20a and a retainer portion 20b of the pressure spring 20 and has an outer peripheral cam surface of a substantially semi-circular shape.

Figure 12:
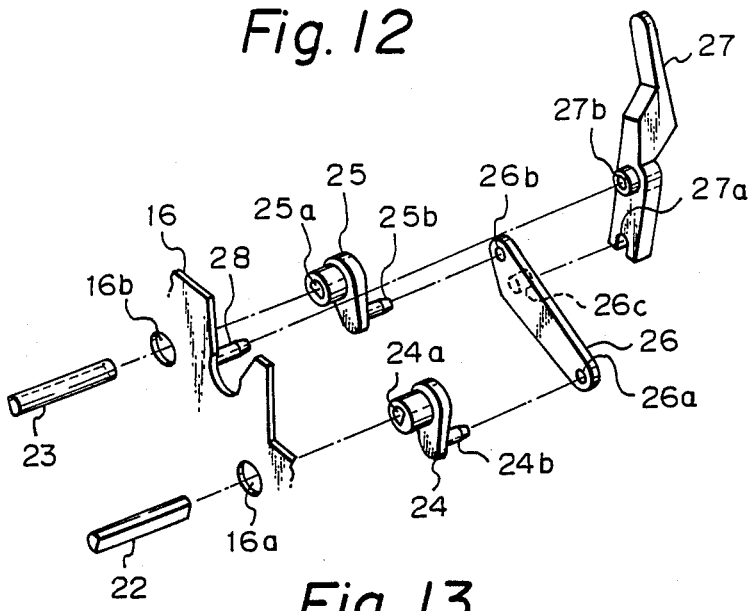
FIG. 12 is an exploded perspective view showing a connecting mechanism interconnecting two pinch roller actuating mechanisms of the printing unit.

The first and second pinch roller actuating mechanisms are operatively connected with each other by a linkage connecting means or mechanism. The linkage connecting mechanism includes a first release link 25 firmly connected with the first release camshaft 23 for movement in unison together, a second release link 24 firmly connected with the second release camshaft 22 for movement in unison together other and a connecting rod 26 pivotably connecting the first and second release links 25, 24. As shown in FIG. 12, the first release link 25 has a horizontal socket pin projecting from one end of the link 25 in one direction and rotatably received in a hole 16b in a side plate of the side frame 16, and a horizontal pivot pin 25b projecting from the other end of the link 25 in the opposite direction and rotatably received in a hole 26b in the connecting rod 26. The socket pin has an axial hole 25a complementary in contour to the first camshaft 23 and fitted over the camshaft 23. Likewise, the second release link 24 has a horizontal socket pin projecting from one end of the link 24 in one direction and rotatably received in a hole 16a in the side plate 16, and a horizontal pivot pin 24b projecting from the other end of the link 24 in the opposite direction and rotatably received in another hole 26a in the connecting rod 26. The socket pin has an axial hole 24a complementary in contour to the second release camshaft 22 and fitted over the camshaft 22. A release lever 27 is pivotably connected on the side plate 16 and also is pivotably connected to the connecting rod 26 for simultaneously turning the first and second release camshafts 23, 22. The release lever 27 has a groove 27a fitted over a horizontal pin 26c projecting from the connecting rod 26, and a recessed socket 27b rotatably fitted over a horizontal pin 28 fixed to the side plate 16.

The first and second pinch roller actuating mechanisms are normally held in a paper-locking position shown in FIG. 9. In this instance, the first and second pressure springs 21, 20 are separated from flat cam surface portions of the corresponding release camshaft 23, 22, so that the first and second pinch rollers 19b, 19a are brought into pressing contact with the platen 14 under the force of the respective pressure springs 21, 20.

When the release lever 27 is turned or tilted in the direction of the arrow G to move the connecting rod 26 in the direction of the arrow H, the first and second release links 25, 24 are simultaneously turned counterclockwise about the longitudinal axis of the first and second release camshafts 23, 22. Due to integral connection with the release links 25, 24, the camshafts 23, 22 are turned counterclockwise about their longitudinal rotation axes through an angle of 90 degrees as shown in FIG. 10, thereby retracting the first and second pinch rollers 19b, 19a away from the platen 14 against the force of the first and second pressure springs 21, 20.

Figure 13:
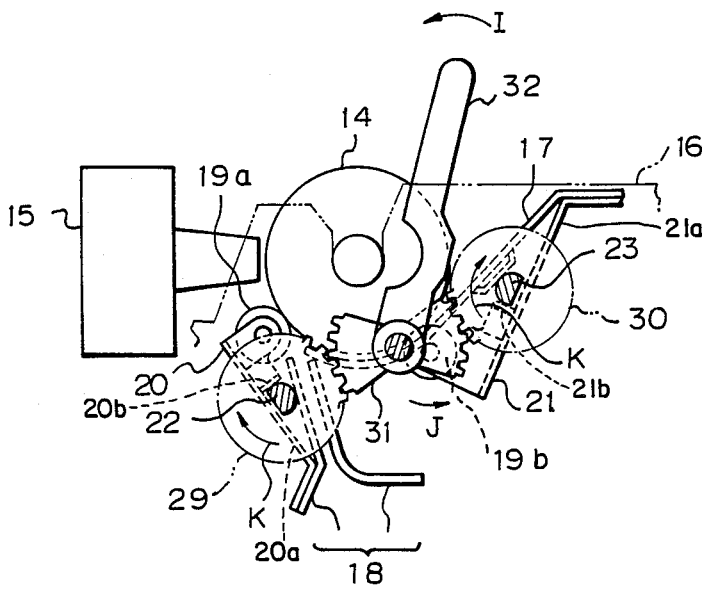
FIG. 13 is a schematic side elevational view, partly in cross section, of another modified printing unit with parts in a paper-locking position.

A modified connecting mechanism shown in FIG. 13 comprises a gear train composed of an externally toothed first release gear 30 firmly connected to the first release camshaft 23 for simultaneous rotation therewith, an externally toothed second release gear 29 firmly connected to the second release camshaft 22 for simultaneous rotation therewith, and an externally toothed drive gear 31 held in driving mesh with the first and second release gears 30, 29 and firmly connected to a pivotable release lever 32 for simultaneous rotation therewith.

With the connecting mechanism thus constructed, when the first and second pinch rollers 19b, 19a are to be retracted away from the platen 14, the release lever 32 is turned in the direction indicated by the arrow I to turn the drive gear 31 in the direction indicated by the arrow J. This angular motion of the drive gear 31 causes the first and second release gears 30, 29 to be simultaneously turned in the directions indicated by the arrows K. Consequently, the first and second release camshafts 23, 22 are turned about their own axes through an angle of 90 degrees, thereby simultaneously displacing the pinch rollers 19b, 19a away from the platen 14 against the force of the first and second pressure springs 21, 20. When the pinch rollers 19b, 19a are to be pressed against the platen 14, the release lever 32 is turned in the clockwise direction in FIG. 13.

Obviously, various modifications and variations of the present invention are possible in the light of the above teachings. It is therefore to be understood that the invention may be practiced otherwise than as specifically described and still be within the scope of the appended claims.

What is claimed is:

1. A printer comprising:

(a) a cylindrical platen;

(b) a pinch roller;

(c) a stationary paper chute extending along an outer peripheral surface of said platen over a limited angular extent thereof so as to define therebetween a paper feed passage, said paper chute having an opening through which said pinch roller is movable into and out of said paper feed passage; and (d) a pinch roller actuating mechanism including (1) a pressure spring fixedly secured to said paper chute for biasing said pinch roller against said platen, said pressure spring being composed of a cantilevered resilient strip having a free end on which said pinch roller is rotatably supported, and (2) a release camshaft rotatably disposed between said paper chute and said pressure spring and angularly movable about a rotation axis of said release camshaft to resiliently displace said pressure spring in a direction to move said pinch roller away from said platen, said release camshaft having an outer peripheral cam surface composed of an arcuate portion and a flat portion such that said cam surface has a substantially semi-circular cross section taken in a plane normal to said rotation axis, said paper chute and said cantilevered pressure spring extending at an angle to one another with a space defined therebetween, said space becoming wider in a direction from a fixed end to said free end of said cantilevered pressure spring, said release camshaft being resiliently retained within said space and supported by and between said pressure spring and said paper chute, said pressure spring having a retainer portion disposed adjacent to said free end and guidingly engageable with a portion of said outer peripheral cam surface of said release camshaft, said retainer portion extending at an angle to the general plane of said pressure spring in a direction toward said paper chute.

2. A printer according to claim 1, wherein said flat cam surface portion of said release camshaft is held in contact with said pressure spring when said pinch roller is biased against said platen by said pressure spring, said pressure spring including a resilient tongue normally extending at an angle to the general plane of said resilient strip and held in contact with said flat cam surface of said release camshaft when said pinch roller is biased against said platen by said pressure spring.

3. A printer according to claim 2, wherein said paper chute includes a guide projection facing said pressure spring and held in contact with said outer peripheral cam surface of said release camshaft.

4. A printer comprising:

(a) a cylindrical platen;

(b) a pinch roller;

(c) a stationary paper chute extending along an outer peripheral surface of said platen over a limited angular extent thereof so as to define therebetween a paper feed passage, said paper chute having an opening through which said pinch roller is movable into and out of said paper feed passage; and (d) a pinch roller actuating mechanism including (1) a pressure spring fixedly secured to said paper chute for biasing said pinch roller against said platen, said pressure spring being composed of a cantilevered resilient strip having a free end on which said pinch roller is rotatably supported, and (2) a release camshaft rotatably disposed between said paper chute and said pressure spring and angularly movable about a rotation axis of said release second release camshaft to resiliently displace said second pressure spring in a direction to move said second pinch roller away from said platen, said second release camshaft having an outer peripheral cam surface composed of an arcuate portion and a flat portion such that said cam surface has a substantially semi-circular cross section taken in a plane normal to said rotation axis of said second release camshaft;

(h) means for operatively connecting said pinch roller actuating mechanism and said second pinch roller actuating mechanism together; and (i) a release lever operatively connected with said connecting means for simultaneously driving said pinch roller actuating mechanism and said second pinch roller actuating mechanism to move said pinch roller and said second pinch roller in unison with each other toward and away from said platen, said paper guide and said second cantilevered pressure spring extending at an angle to one another with a gap defined therebetween, said gap becoming wider in a direction from a fixed end to said free end of said second cantilevered pressure spring, said second release camshaft being resiliently retained within said gap and supported by and between said second pressure spring and said paper guide, said second pressure spring having a retainer portion disposed adjacent to said free end thereof and guidingly engageable with a portion of said outer peripheral cam surface of said second release camshaft, said retainer portion of said second pressure spring extending at an angle to the general plane of said pressure spring in a direction toward said paper guide. camshaft to resiliently displace said pressure spring in a direction to more said pinch roller away from said platen, said release camshaft having an outer peripheral cam surface composed of an arcuate portion and a flat portion such that said cam surface has a substantially semi-circular cross section taken in a plane normal to said rotation axis, said paper chute and said cantilevered pressure spring extending at an angle to one another with a space defined therebetween, said space becoming wider in a direction from a fixed end to said free end of said cantilevered pressure spring, said release camshaft being resiliently retained within said space and supported by and between said pressure spring and said paper chute, said pressure spring having a retainer portion disposed adjacent to said free end and guidingly engageable with a portion of said outer peripheral cam surface of said release camshaft, said retainer portion extending at an angle to the general plane of said pressure spring in a direction toward said paper chute, (e) a paper guide disposed adjacent to said platen and having defined therein a second paper feed passage;

(f) a second pinch roller disposed upstream of said second paper feed passage;

(g) a second pinch roller actuating mechanism including (1) a second pressure spring secured to said paper guide for biasing said second pinch roller against said platen, said second pressure spring being composed of a cantilevered resilient strip having a free end on which said second pinch roller is rotatably supported, and (2) a second release camshaft rotatably disposed between said paper guide and said second pressure spring and angularly movable about a rotation axis of said

5. A printer according to claim 4, wherein said connecting means includes a first release link firmly connected with said release camshaft for simultaneous rotation therewith, a second release link firmly connected with said second release camshaft for simultaneous rotation therewith, and a connecting rod pivotably interconnecting said first and second release links and pivotably connected with said release lever.

6. A printer according to claim 4, wherein said connecting means includes an externally toothed first release gear firmly connected with said first release camshaft for simultaneous rotation therewith, an externally toothed second release gear firmly connected with said second release camshaft for simultaneous rotation therewith and an externally toothed drive gear held in driving mesh with said first and second release gears and firmly connected with said release lever.

* * * * *